United States Patent [19]

Ohgami et al.

[11] Patent Number: 4,697,564

[45] Date of Patent: Oct. 6, 1987

[54] AIR-FUEL RATIO CONTROL SYSTEM

[75] Inventors: Masaaki Ohgami, Musashino; Hiroki Yasuda, Koganei; Masaharu Kubota, Musashino, all of Japan

[73] Assignee: Fuji Jukogyo Kabushiki Kaisha, Tokyo, Japan

[21] Appl. No.: 710,331

[22] Filed: Mar. 11, 1985

[30] Foreign Application Priority Data

Mar. 13, 1984 [JP] Japan ..... 59-48773

[51] Int. Cl.[4] ..... F02D 41/14; F02M 7/14

[52] U.S. Cl. ..... 123/440; 123/489

[58] Field of Search ..... 123/440, 489

[56] References Cited

U.S. PATENT DOCUMENTS

| | | | |
|---|---|---|---|
| 4,073,269 | 2/1978 | Herth et al. | 123/489 |
| 4,099,491 | 7/1978 | Reddy | 123/489 X |
| 4,204,482 | 5/1980 | Harada et al. | 123/440 |
| 4,251,989 | 2/1981 | Norimatsu et al. | 123/489 X |
| 4,320,730 | 3/1982 | Takada et al. | 123/440 |
| 4,364,356 | 12/1982 | Gerhold | 123/440 |
| 4,408,584 | 10/1983 | Yabuhara et al. | 123/440 |
| 4,428,345 | 1/1984 | Bertsch et al. | 123/440 |

FOREIGN PATENT DOCUMENTS

| | | | |
|---|---|---|---|
| 136035 | 11/1976 | Japan . | |
| 132021 | 10/1979 | Japan | 123/489 |
| 37560 | 3/1980 | Japan . | |
| 46037 | 3/1982 | Japan | 123/489 |
| 140450 | 8/1983 | Japan | 123/489 |

*Primary Examiner*—Tony M. Argenbright

*Attorney, Agent, or Firm*—Martin A. Farber

[57] ABSTRACT

An air-fuel ratio control system for a carburetor of an internal combustion engine comprises an $O_2$-sensor for detecting the concentration of the oxygen constituent of exhaust gases passing through an exhaust passage, an on-off electromagnetic valve for correcting the air-fuel ratio of the air-fuel mixture supplied by the carburetor, an electronic control circuit comprising a comparator for comparing an output signal of the $O_2$-sensor, an integration circuit, and a driving circuit for producing driving pulses for driving the electromagnetic valve in dependency on an output signal of the integration circuit for controlling the air-fuel ratio. A detector, such as an ignition pulse generating device, is provided for detecting conditions of operation of the internal combustion engine and for producing an engine operation signal, and a current control circuit responds to the engine operation signal for producing an output current. A delay circuit is provided to respond to the output current for delaying the output signal of the integration circuit.

12 Claims, 10 Drawing Figures

AIR-FUEL RATIO CONTROL SYSTEM

BACKGROUND OF THE INVENTION

The present invention relates to an air-fuel ratio control system provided with an electrically-controlled carburetor in an intake system of an internal combustion engine, with a three-way catalytic converter in an exhaust system, and with an $O_2$-sensor for detecting the oxygen concentration of exhaust gases.

The air-fuel ratio control system controls the air-fuel ratio of the air-fuel mixture to a stoichiometric air-fuel ratio at which the three-way converter operates most effectively. However, it is desirable to vary the air-fuel ratio according to conditions of engine operation. For example, at rapid acceleration, the air-fuel mixture is enriched, and at deceleration, the mixture is diluted.

A control system for controlling the air-fuel ratio to a rich value and a lean value is disclosed in Japanese Laid Open No. 51-136035. The control system comprises a comparator for comparing the output of the $O_2$-sensor with a reference value, a proportion and integration circuit for amplifying and integrating the output of the comparator, a pulse generating circuit responsive to the output of the proportion and integration (hereinafter called PI) circuit for producing pulses, and a driver for driving an electromagnetic valve in dependency on the pulses for controlling the air-fuel ratio. In the system, the reference value is shifted according to conditions of engine operation so as to vary the air-fuel ratio. However, in such a system, since the proportion component in the output of the PI circuit is also varied by the shifting of the reference value, it is difficult to finely control the air-fuel ratio.

To resolve such a problem, a system for controlling the duty ratio of the pulses by delaying the integration component in the output of the PI circuit is disclosed in Japanese Laid Open No. 55-37560. In the system, when the integration component is delayed, the duty ratio of the pulses is decreased, so that the amount of air decreases to enrich the mixture. However, in the air-fuel ratio control system, the output voltage of the $O_2$-sensor fluctuates periodically, and the period of the fluctuation increases with decrease of the speed of the engine. If the delay time is constant, the duty ratio of the pulses varies with the variation of the period, that is the engine speed. Accordingly, a proper control of the air-fuel ratio can not be performed.

SUMMARY OF THE INVENTION

The object of the present invention is to provide a control system which may control the air-fuel ratio to a value dependent on variation of engine conditions such as engine speed, temperature of the coolant, amount of intake air and others.

According to the present invention, there is provided an air-fuel ratio control system for a carburetor of an internal combustion engine having an intake passage, an exhaust passage, an $O_2$-sensor for detecting the concentration of the constituent of exhaust gases passing through the exhaust passage, an on-off electromagnetic valve for correcting the air-fuel ratio of the air-fuel mixture supplied by the carburetor, an electronic control circuit comprising a comparator for comparing an output signal of the $O_2$-sensor, an integration circuit, and a driving circuit for producing driving pulses for driving the electromagnetic valve in dependency on an output signal of the integration circuit for controlling the air-fuel ratio to a value approximate to the stoichiometric air-fuel ratio.

The system comprises detector means for detecting conditions of operation of the internal combustion engine and for producing an engine operation signal, a current control circuit responsive to the engine operation signal for producing an output current, a delay circuit responsive to the output current for delaying the output signal of the integration circuit.

In an aspect of the present invention, the detector means comprises an ignition pulse generating device and a frequency-to-voltage converter for converting the output pulses of the ignition pulse generating device to voltage.

The other objects and features of this invention will be apparently understood from the following description with reference to the accompanying drawings.

DETAILED DESCRIPTION OF THE PREFERRED EMBODIMENTS

Figure 1:
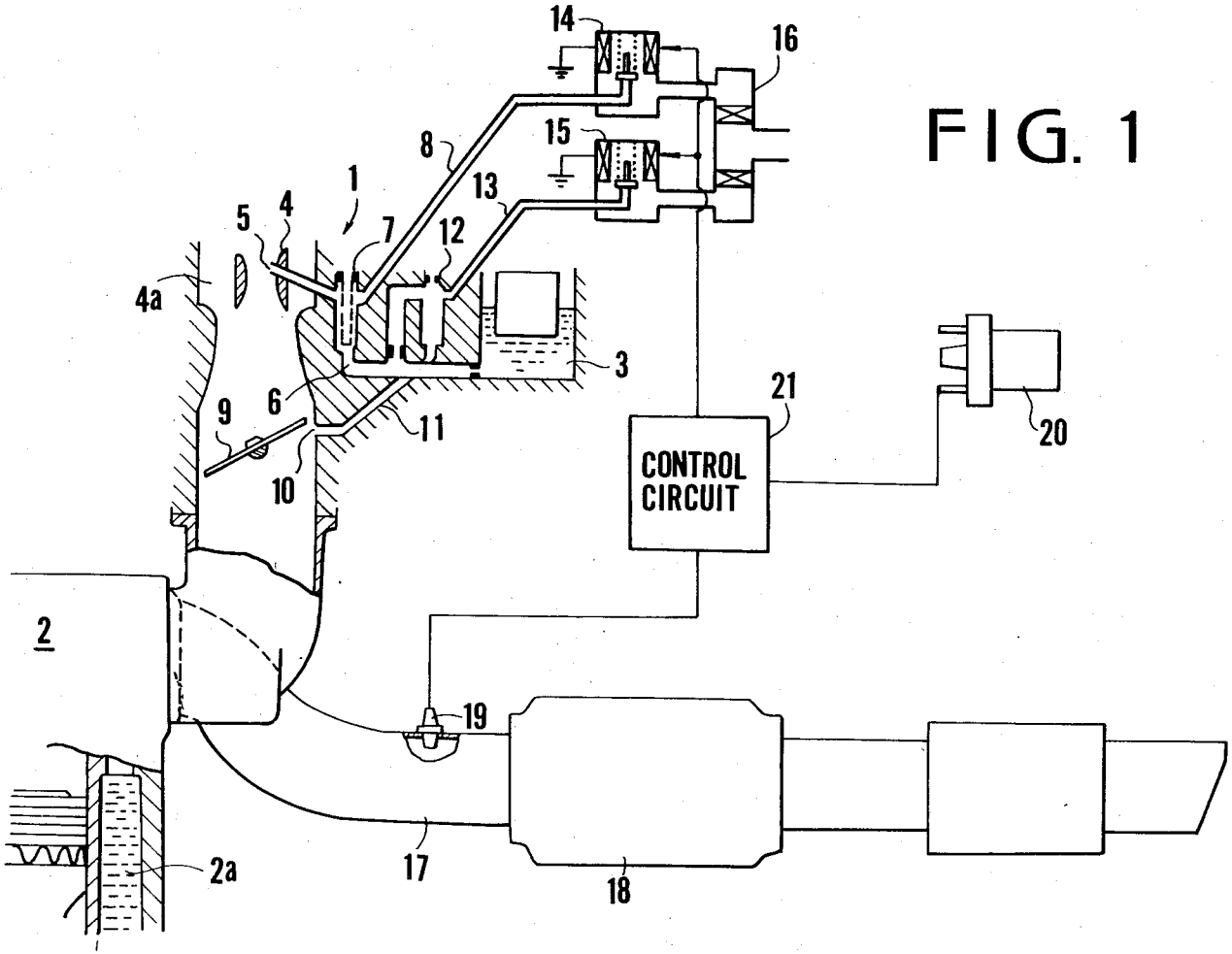
FIG. 1 is a schematic diagram showing a control system of the present invention.

Referring to FIG. 1 showing schematically an air-fuel ratio control system according to the present invention, an internal combustion engine 2 mounted on a vehicle (not shown) is provided with a carburetor 1, which comprises a correcting air passage 8 communicating with an air-bleed 7 provided in a main fuel passage 6 between a float chamber 3 and a nozzle 5 in a venturi 4 in an intake passage 4*a*. Another correcting air passage 13 communicates with another air-bleed 12 which is provided in a slow fuel passage 11 which diverges from the main fuel passage 6 and extends to a slow port 10 opening in the vicinity of a throttle valve 9 in the intake passage 4*a*. These correcting air passages 8 and 13 are communicated with on-off type electromagnetic valves 14, 15, induction sides of which are communicated with the atmosphere through an air cleaner 16. Further, a three-way catalytic converter 18 is provided in an exhaust pipe 17 downstream of the engine, and an $O_2$-sensor 19 is provided on the exhaust passage 17 between the engine 2 and the converter 18 to detect the oxygen concentration of the exhaust gases as the air-fuel ratio of the mixture burned in the cylinders of the engine.

An ignition pulse generating device 20 is provided to generate pulses in synchronism with the engine ignition. The output signal of the device 20 is sent to a control circuit 21 which produces an output signal to actuate the electromagnetic valves 14, 15 to open and close at duty ratios which are variable according to the output signals of the $O_2$-sensor 19 and device 20. Thus, a great deal of air is supplied to the fuel system through the air correcting passages 8, 13 to produce a lean air-fuel mixture or a small amount of air is supplied to enrich the air-fuel mixture.

Figure 2A:
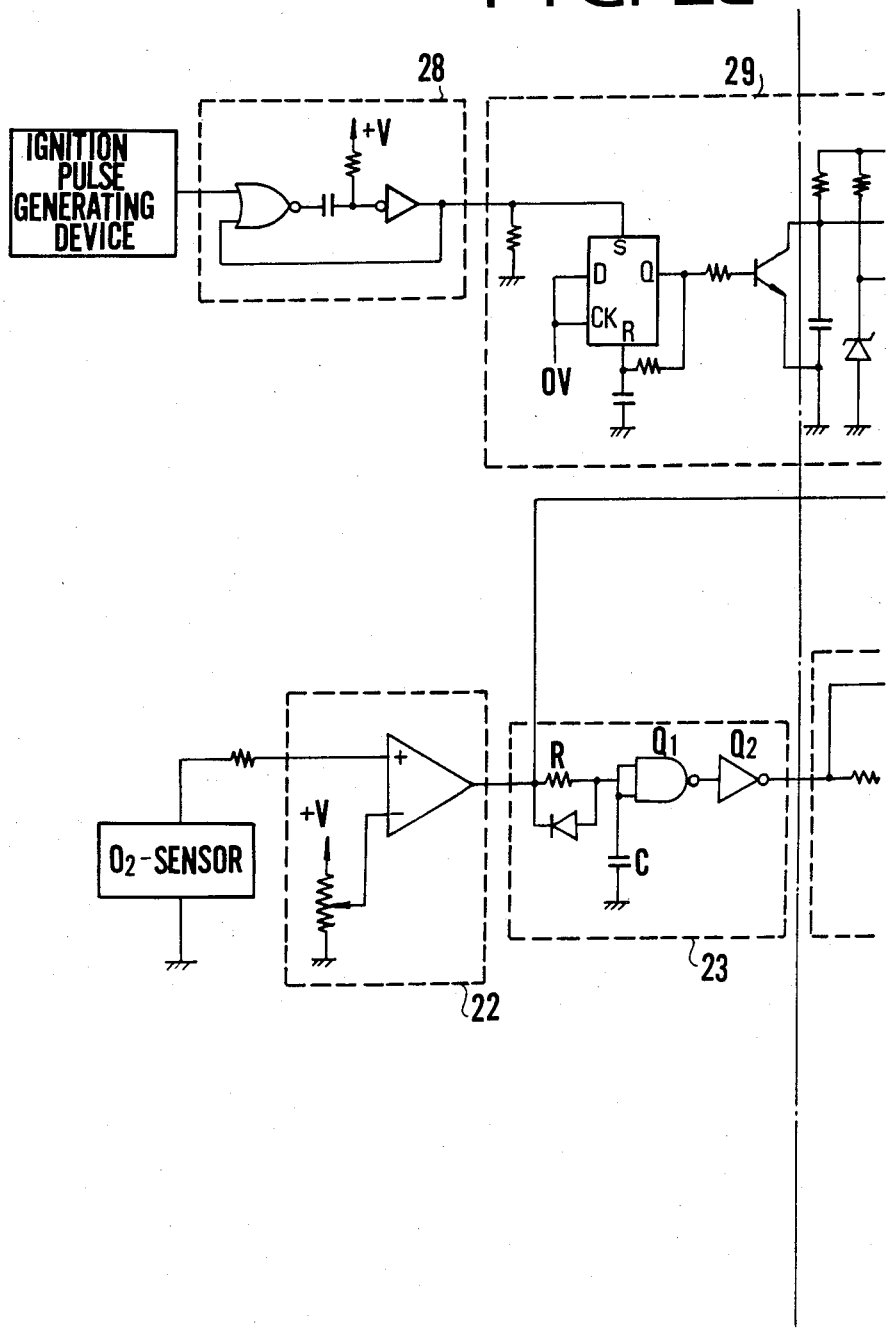
FIGS. 2*a* and 2*a'* show an air-fuel control circuit in accordance with the present invention.
Figure 2A:
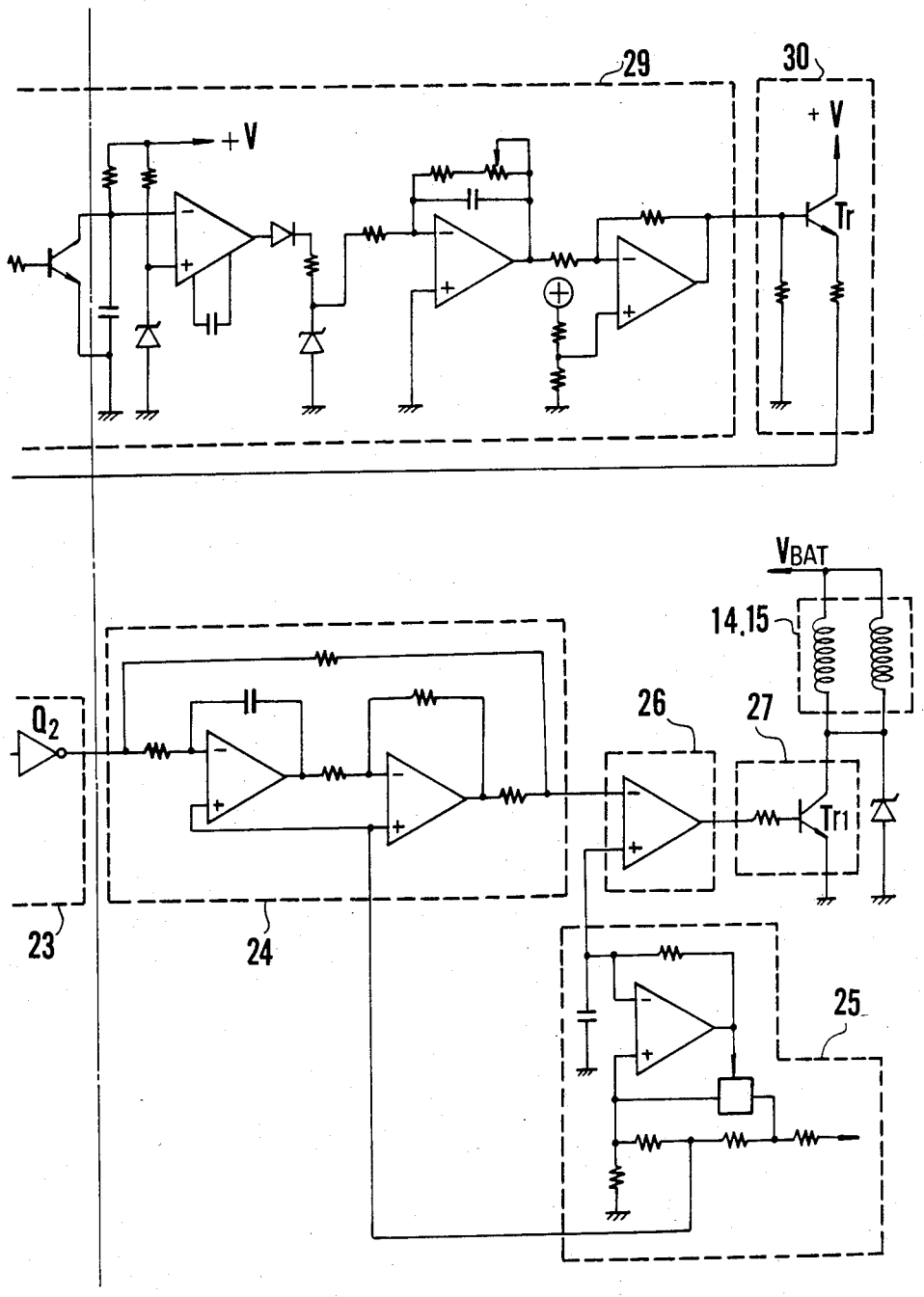

FIG. 2*a* shows the construction of the control circuit 21. The output of the $O_2$-sensor 19 is applied to a PI (proporation and integration) control circuit 24 through a comparator 22 and a delay circuit 23. The output of the PI control circuit 24 is applied to another comparator 26. The comparator 26 compares the output of the PI control circuit 24 with triangular wave pulses from a triangular wave pulse generator 25 and produces square wave pulses as a result of the comparison. The square wave pulses are fed to the electromagnetic valves 14, 15 via a driver 27 for operating the valves.

Pulses from the ignition pulse generating device 20 are applied to a F/V (frequency-to-voltage) converter 29 through a monostable multivibrator 28, so that an output having voltage in proportion to the frequency of the ignition pulses is produced from the F/V converter. The output is applied to a current control circuit 30 to control the current passing in a transistor Tr. The output of the current control circuit 30 is applied to the input of the delay circuit 23. The delay circuit 23 comprises a resistor R, capacitor C, NAND gate $Q_1$ and inverter $Q_2$. The charging time of the capacitor increases with a decrease of the charging current to provide larger delay time.

Figure 4:
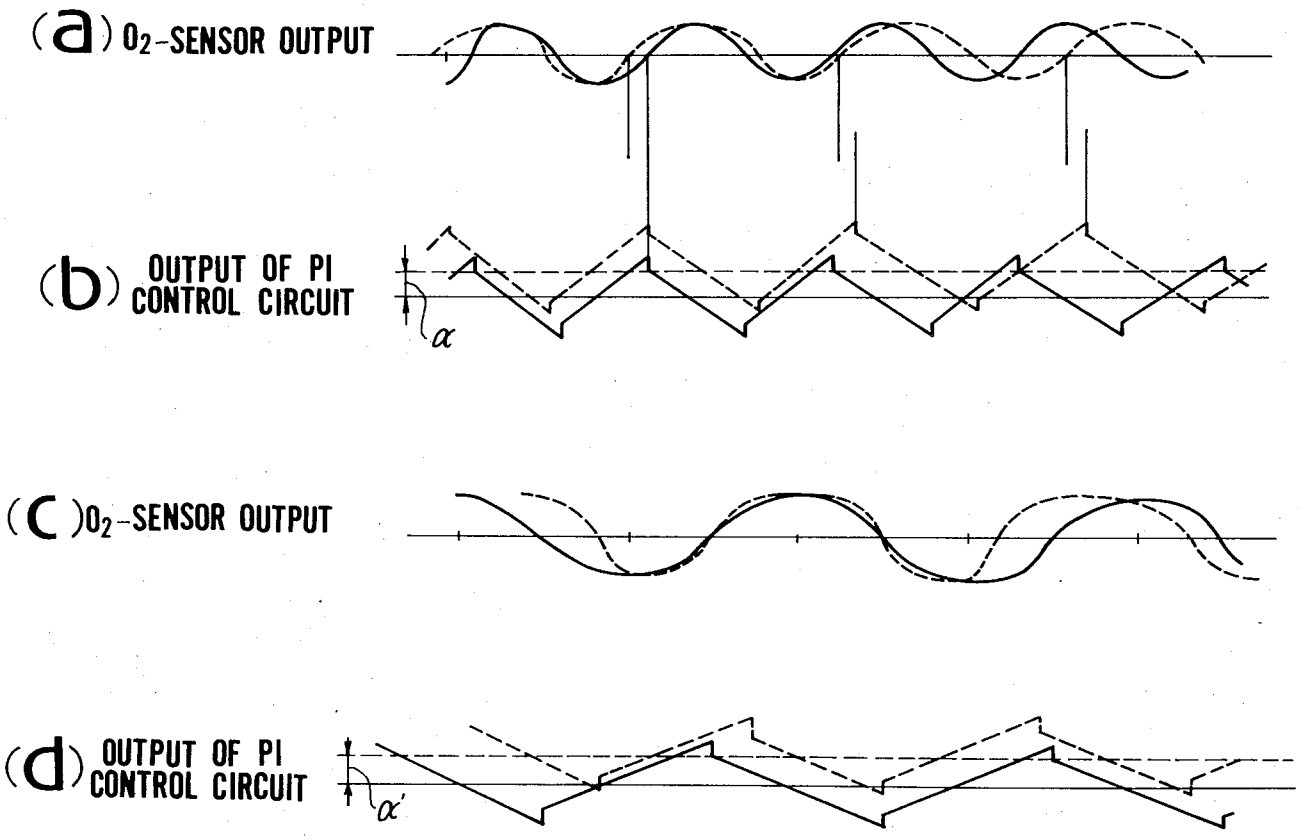
FIGS. 4*a* to 4*d* are waveforms at various positions of FIGS. 2*a*, 2*a'*.

In operation, the output of the $O_2$-sensor 19 (FIG. 4*a*) is compared with a reference value in the comparator 22. The output of the comparator 22 to produce an air-fuel ratio correcting signal comprising pulses is sent to the PI control circuit 24 through the delay circuit 23 which triggers the gate $Q_1$ after the delay time by the charging of the capacitor C in response to the positive-going leading edge of the pulses from the comparator 22 which are adjusted in level by the current signal from the current control circuit 30, and capacitor C discharges rapidly by the diode in the delay circuit 23 providing a rapid discharge by the negative-going trailing edge of the pulses from the comparator 22. Thus the delay circuit 23 produces output pulses having a duty ratio modified by the current control circuit and in this manner different from that of the pulses from the output of the comparator 22. The PI control circuit 24 performs an integration operation of the input from the delay circuit 23 to produce an output having sawtooth waveforms (FIG. 4*b*). The comparator 26 compares the output with triangular waves from the triangular wave pulse generator 25 to produce square wave pulses. The square wave pulses turn on and off a transistor $TR_1$ of the driver 27 so that the electromagnetic valves 14, 15 are driven and a feedback control operation is carried out to cause the air-fuel ratio of the mixture to be supplied to converge to stoichiometry.

Figure 3:
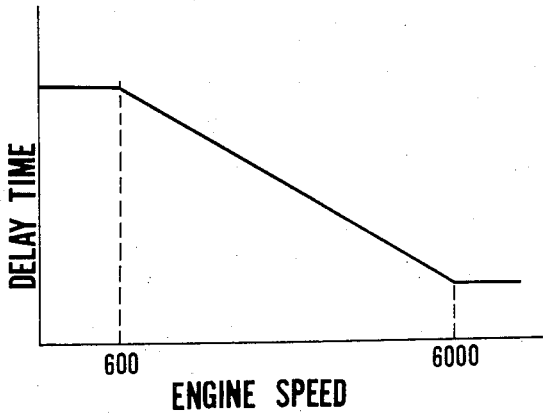
FIG. 3 is a graph showing relationship between engine speed and delay time.

FIG. 3 shows the relationship between engine speed and delay time of the delay circuit 23. The delay time increases with the decrease of the engine speed.

Sawtooth waves shown by a solid line in FIG. 4*b* represent an output of the PI control circuit 24 in the state of the output of the $O_2$-sensor 19 shown in FIG. 4*a* without time delay. By providing the delay circuit 23 and applying the current from the current control circuit 30 to the delay circuit 23, the output of the PI control circuit 24 is delayed as shown by dashed line in FIG. 4*b*. Thus, the level of the output is raised an amount $\alpha$. When such a high level output is compared with the triangular waves from the triangular wave pulse generator 25, the duty ratio of the pulses from the comparator 26 decreases. Thus, the air-fuel mixture supplied from the carburetor is enriched.

At a low engine speed, the period of the waves of the output of the $O_2$-sensor increases as shown in FIG. 4*c*, and hence the charging current for the PI control circuit decreases. Accordingly, the level of the output of the PI control circuit without the delay circuit, which is shown by the solid line in FIG. 4*d*, is lower than FIG. 4*b*. However, since the delay time is increased by the current from the circuit 30, the level of the output of the PI control circuit is increased an amount $\alpha'$ as shown by the dashed line in FIG. 4*d*. Thus, the air-fuel ratio is kept at a rich value dependent on the engine speed.

Figure 5:
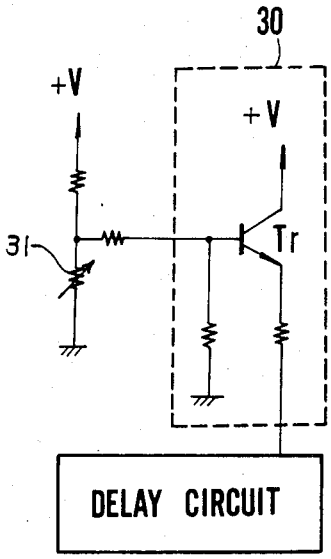
FIG. 5 is a delay circuit dependent on coolant temperature.

FIG. 5 shows another embodiment of the present invention, which is provided with a coolant temperature sensor 31 for detecting the temperature of coolant in water jackets 2*a* of the engine. The output of the sensor 31 is applied to the base of the transistor Tr of the current control circuit 30. The delay time of the delay circuit 23 is increased with decrease of the temperature. In accordance with this circuit, the air-fuel ratio is controlled in the same manner as the previous embodiment.

Figure 2B:
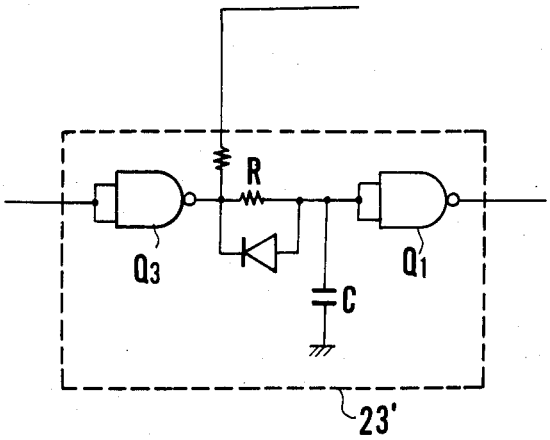
FIG. 2*b* shows a modification of a delay circuit.

FIG. 2*b* shows another example of a delay circuit 23'. The delay circuit comprises an inverter $Q_3$, resistor R, capacitor C, and NAND gate $Q_1$. The output of the comparator 22 is inverted by the inverter $Q_3$. The operation of the delay circuit is substantially the same as the delay circuit 23.

Although above described embodiments are constructed by analog circuits, the system can also be composed by a microcomputer system.

In accordance with the present invention, the output of the integration circuit is delayed in dependency on conditions of the engine so as to maintain the air-fuel ratio at a substantially constant value. Thus, the emission control of the engine is properly performed.

While the presently preferred embodiments of the present invention has been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for a carburetor of an internal combustion engine having an intake passage, and an exhaust passage from the engine, the control system comprising an $O_2$-sensor for detecting concentration of a constituent of exhaust gases passing through the exhaust passage, an on-off electromagnetic valve for correcting the air-fuel ratio of air-fuel mixture supplied by the carburetor, an electronic control circuit comprising a comparator for comparing an output signal of the $O_2$-sensor with a reference value and outputting a correcting signal, an integration circuit operatively connected to the comparator so as to operatively receive said correcting signal and producing an output signal dependent on said correcting signal, and a driving circuit for producing driving pulses for driving the electromagnetic valve in dependency on the output signal of the integration circuit for controlling the air-fuel ratio to a value approximately equal to the stochiometric air-fuel ratio constituting said correcting of the air-fuel ratio, the improvement comprising:

detector means for detecting speed of the internal combustion engine for producing an engine operation signal constituting an engine speed signal;

current control circuit means responsive to the engine speed signal for producing an output current dependent on said speed signal; and delay circuit means responsive to the output current for delaying the correcting signal operatively received by the integration circuit by a delay time such that the delay time increases with decreasing engine speed, so as to keep the air-fuel ratio at a rich value dependent on the engine speed.

2. The air-fuel ratio control system according to claim 1 wherein the detector means comprises an ignition pulse generating device and a frequency-to-voltage converter for converting the output pulses of the ignition pulse generating device to voltage.

3. The control system as set forth in claim 2 wherein a monostable multivibrator is connected between said frequency-to-voltage converter and said ignition pulse generating device.

4. The control system as set forth in claim 1 wherein said delay circuit means is connected between said comparator and said integration circuit.

5. The control system as set forth in claim 1 wherein said delay circuit means comprises a resistor and diode in parallel, an inverter, and a NAND gate connected between one junction point of said parallel combination of resistor and diode and said inverter, and a capacitor connected to inputs of said NAND gate and a junction of said parallel resistor and diode, said inverter is connected to an input of said integration circuit, and said current control circuit means and said comparator are connected to the other junction point of said parallel combination of resistor and diode.

6. The control system as set forth in claim 5, wherein said correcting signal from said comparator comprises a plurality of pulses having a period dependent on the engine speed, said delay circuit means, by said delaying of said correcting signal operatively received by the integration circuit, changes the pulse duty ratio of said pulses.

7. The control system as set forth in claim 6, wherein said delay circuit means delays a positive-going excursion of said pulses without changing the negative-going excursion of said pulses.

8. The control system as set forth in claim 6, wherein said delay circuit means decreases said pulse duty ratio of said pulses as the engine speed decreases.

9. The control system as set forth in claim 6, wherein said current control circuit means provides a continuous current to the delay circuit means dependent on the engine speed.

10. The control system as set forth in claim 1 wherein said delay circuit means comprises an inverter, first and second inverting means, a parallel combination of resistor and diode connected between said first and said second inverting means, and a capacitor connected to an input terminal of said second inverting means, an output of said second inverting means is connected to said integration circuit, said current control circuit means is connected between the output of said first inverting means and said parallel combination of resistor and diode, and said comparator is connected to the input of said first inverting means.

11. The control system as set forth in claim 1 wherein said current control circuit means comprises a transistor.

12. The control system as set forth in claim 1 wherein the delay time of the delay circuit means increases substantially linearly with a decrease of engine speed.

* * * * *